United States Patent [19]

Black et al.

[11] 4,021,813

[45] May 3, 1977

[54] GEOMETRICALLY DERIVED BEAM CIRCULAR ANTENNA ARRAY

[75] Inventors: Lawrence M. Black, Olney; Egbert H. Jackson, Jr.; Henry J. Bilow, both of Silver Spring, all of Md.

[73] Assignee: The United States of America as represented by the Secretary of the Navy, Washington, D.C.

[22] Filed: Mar. 5, 1976

[21] Appl. No.: 664,347

Related U.S. Application Data

[63] Continuation-in-part of Ser. No. 484,733, July 1, 1974, abandoned.

[52] U.S. Cl. ..... 343/768; 343/854

[51] Int. Cl.[2] ..... H01Q 3/26

[58] Field of Search ..... 343/768, 771, 853, 854

[56] References Cited

UNITED STATES PATENTS

| | | | |
|---|---|---|---|
| 3,707,719 | 12/1972 | Mark | 343/854 |
| 3,940,770 | 2/1976 | Fassett et al. | 343/854 |

*Primary Examiner*—Eli Lieberman
*Attorney, Agent, or Firm*—R. S. Sciascia; A. L. Branning; R. E. Bushnell

[57] ABSTRACT

An isotropic antenna array formed by a plurality of adjoining stripline elements each having a two bit diode switched parallel feed path. Phase matching wavefronts emitted by groups of successively switched, adjacent antenna elements causes the antenna array to scan through space.

6 Claims, 16 Drawing Figures

GEOMETRICALLY DERIVED BEAM CIRCULAR ANTENNA ARRAY

BACKGROUND OF THE INVENTION

This application makes reference to our earlier C-l-P filed application, Serial Number 484,733, filed 1 July, 1974, now abandoned, for the purpose of obtaining the benefits specified under 35 U.S.C. 120.

The present invention relates to antennae and more particularly to conformal array scanning antennae.

Various mechanical scanning devices have been used to rotate directional antennae in the plane of the horizon. The inherent limitations upon the scanning speed mandated a new type of system. Electronically scanned array antenna systems known in the prior art consist of a set of small antennae symmetrical arranged and connected in a particular configuration to provide for a directional beam which can be moved in space in accordance with the sequence in which the elements of the array are excited. Various devices that have been used to scan an array of elements include phase shifters, compound switching networks, essential power dividers, and complex digital computer systems. In addition, prior art systems have been limited to frequencies differing in accordance with the spatial location of the scanned beam. Although this limitation may not be critical in certain reflective radar applications, it may be quite critical to various information systems.

SUMMARY OF THE INVENTION

The present invention overcomes the limitations and disadvantages of the prior art by providing a stripline antenna element and an array formed by a plurality of adjoining stripline antenna elements cophasally coupled individually through two-bit switched feedlines of different pathlengths to a signal processing device. Isotropic scanning of a spherical sector conformal to the array is achieved by sweeping overlapping sectorates of the sector conformal to stepped groups of 2N+1 adjoining elements. In each step, those N elements symmetric about a normal bisecting the respective sectorate are excited in phase, those elements immediately adjoining those N elements at either end is shut off, those elements next immediately adjoining are fed via a half wavelength longer path of the switched feedline are excited 180° out of phase, while the remaining elements of the array are shut off. Embodiments of the invention have all the advantages of an electronically scanned array antenna without being constrained to varying frequencies for scanning.

It is therefore an object of the present invention to provide an improved electronically scanned array antenna system.

It is also an object of the present invention to provide a reliable electronically scanned array antenna system having a high scanning speed.

It is another object of the present invention is to provide an electronically scanned array antenna system that is simple and inexpensive to construct and operate.

It is yet another object of the present invention to provide an antenna element utilizing the advantages of the stripline art.

It is still yet another object of the present invention to provide an array antenna having maximum gain with the least consumption of power.

It is a further object of the present invention to provide a continuous wave radar system utilizing a high power generator and a sensitive receiver.

BRIEF DESCRIPTION OF THE DRAWINGS

Other objects, advantages and features of the present invention will become apparent from the teachings of the following detailed description of the invention when considered in conjunction with the accompanying drawings, wherein.

DETAILED DESCRIPTION OF THE EMBODIMENTS

Figure 1:
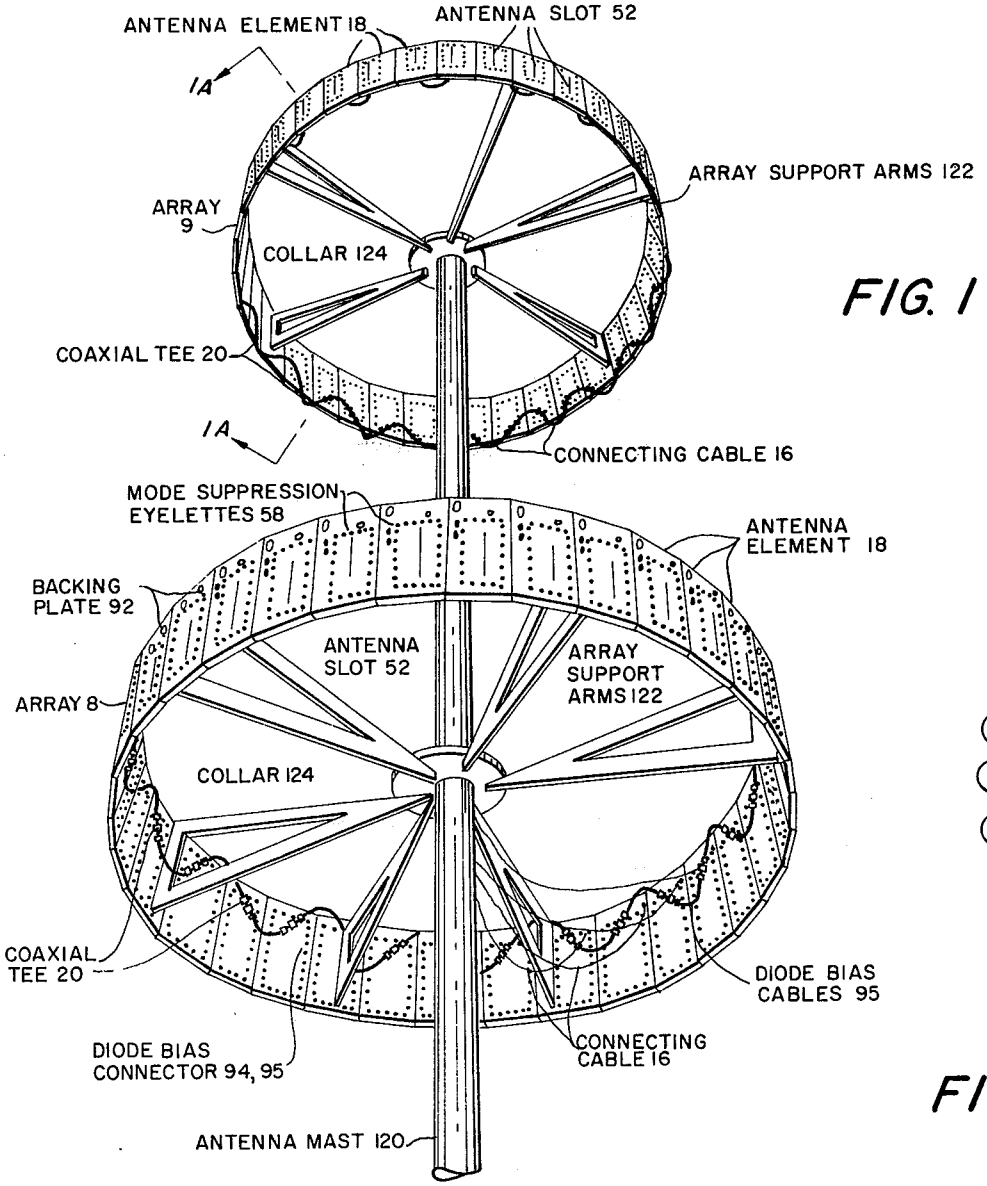
FIG. 1 is an illustration of a system having a pair of circular array antennae.

Referring to the drawings wherein like reference characters designate identical or corresponding parts throughout the various views, several embodiments and the accompanying details of an array antenna and a stripline antenna element utilizable in an array antenna are shown. The array is dedicated to scanning part or all of a spherical sector (e.g., a horizon) depending upon whether the array is an arcuate part of or a complete circular array, respectively, in sectorate parts conformal to stepped groups of 2N+1 antenna elements. The stripline elements, adaptable for use in an array antenna, are slot antennae fed in phase with equal amplitude signals through a two bit parallel path network. An array may be used for transmitting as well as for receiving.

THE ARRAY ANTENNA

Referring now to FIG. 1 wherein there is shown a pair of isotropic circular array antennae 8, 9 constructed with 36 tangential stripline slot antenna elements 18 each. Each array 8, 9 is suspended by support arms 122 and collar 124 and is mounted on a supporting mast 120 and separated from any other array 8, 9 by an empherically determined distance in order to minimize interference. Each antenna element 18 has a single slot 52 fed in phase with an equal amplitude signal through a coaxial tee 20 by a connecting cable 16 that is in turn coupled to a signal processing device (not shown) such as a transmitter or a receiver. A pair of diode bias cables 96 couple an electronic device controlling the path of the radio frequency energy internal to each antenna element 18, to a scanning control 64 (not shown). The slot 52 of each element 18 is oriented vertically normal to a horizontal plane bisecting the spherical sector conformal to that element. It is possible to either align one array 9 about the other array 8, or to contact the individual elements 18 with more than one colinear vertical slot 52 in order to narrow the beam-width of the array. Similarly, when the arrays 8, 9 are properly spaced apart, it is possible to step each array in synchronism with the dedication of one array to transmission and the second array to reception of a continuous radio frequency signal. If but one array is available, it is possible, by means of a transmit-receive switch, to use the array for both transmission and reception of a radio frequency signal.

Figure 2:
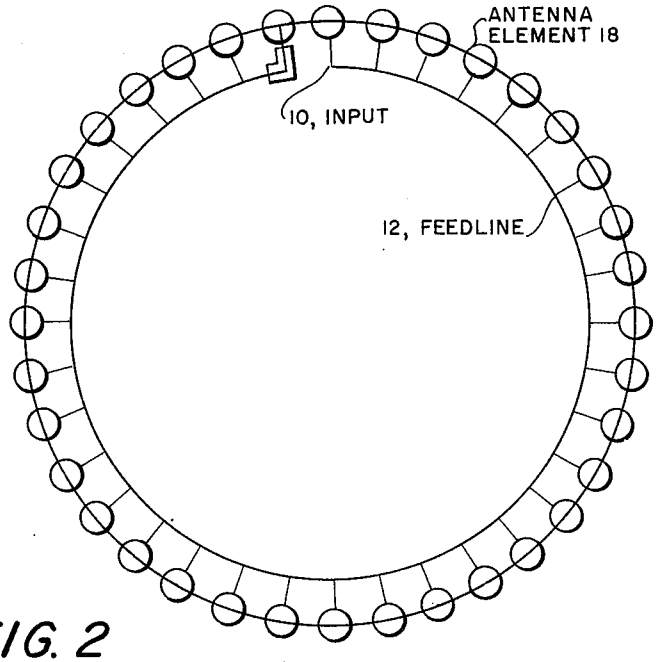
FIG. 2 is a symbolic representation of a circular array antenna having 36 parallel fed antenna elements.
Figure 1A:
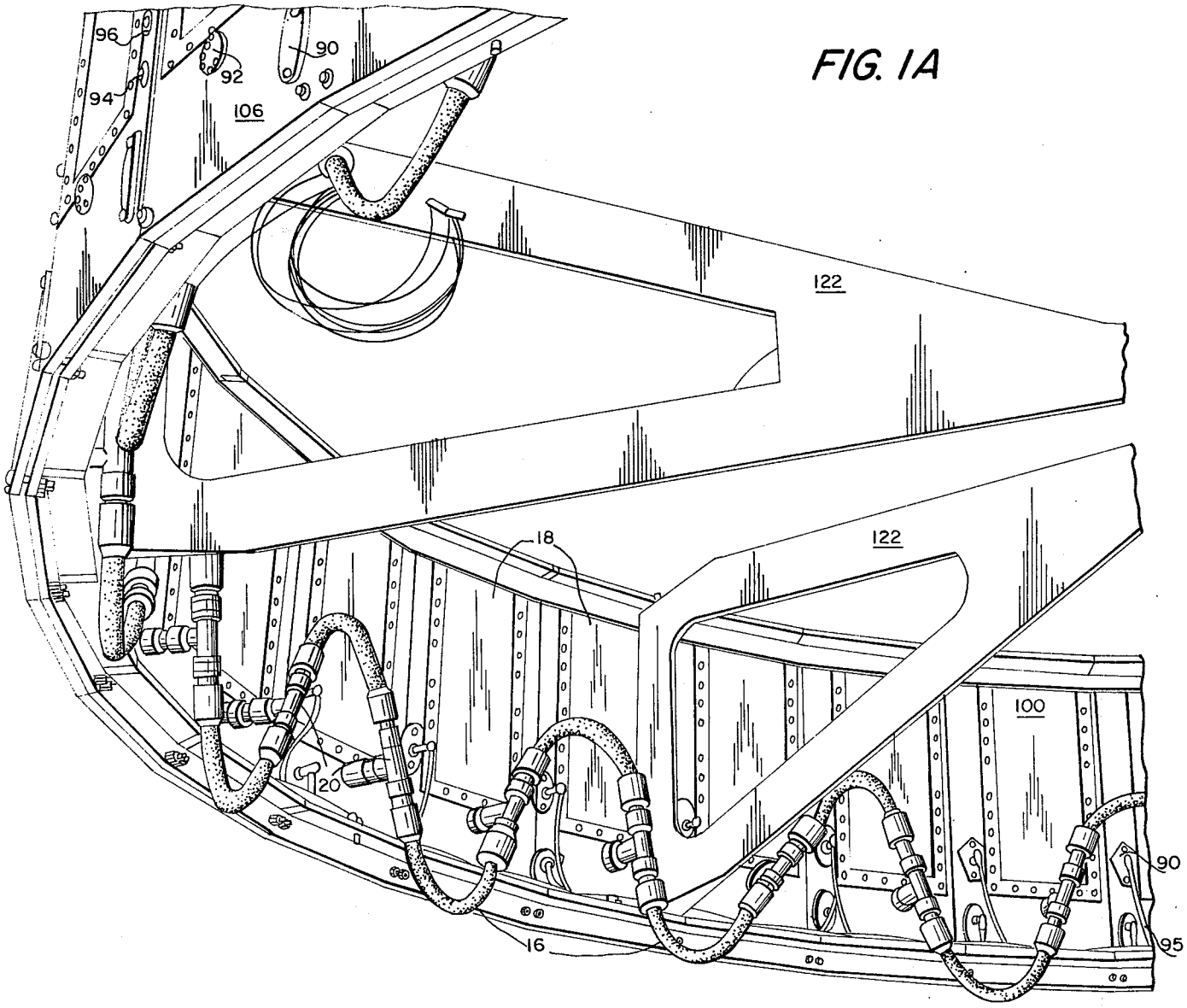
FIG. 1A is an enlarged illustration of the feed line for the antenna shown in FIG. 1.
Figure 3:
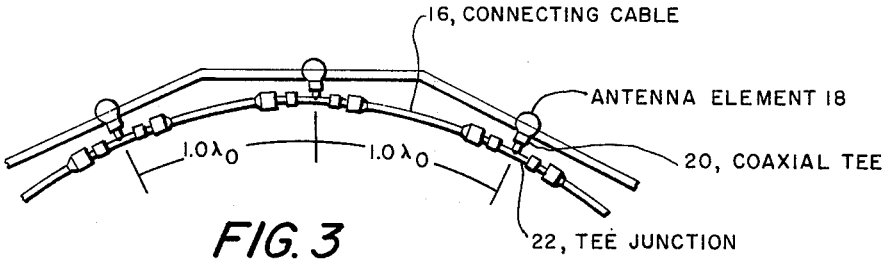
FIG. 3 is sectional illustration of a parallel fed array antenna showing the details of the feed line.

FIG. 2 shows the layout of a circular array having 36 antenna elements 18 cophasally fed by the feedline 12. Radio frequency power is conveyed from a signal processing device (not shown) via input 10, travels through the 36 paths provided by feedline 12, to the corresponding antenna element 18. The elements 18 are successively switched by a two-bit alternate path device (not shown) so as to successively step 2N+1 groups of the elements around the array in 36 steps. FIG. 3 sets forth further details of the corporate feed network. Radio frequency energy is conveyed by the connecting cables 16 and the intervening coaxial tees 20 forming the feedline network 12 of FIG. 1. The pathlength of the radio frequency signal between tee junctions 22 is kept to either a single wavelength or a multiple of a single wavelength of that signal so as to selectively couple the signal, in phase, through the coaxial tee junction 22. The parallel coupled antenna elements 18 therefore present an optimum impedance match to the radio frequency processing device (not shown) and no phase shift arises from the separation of the elements 18.

Figure 4A:
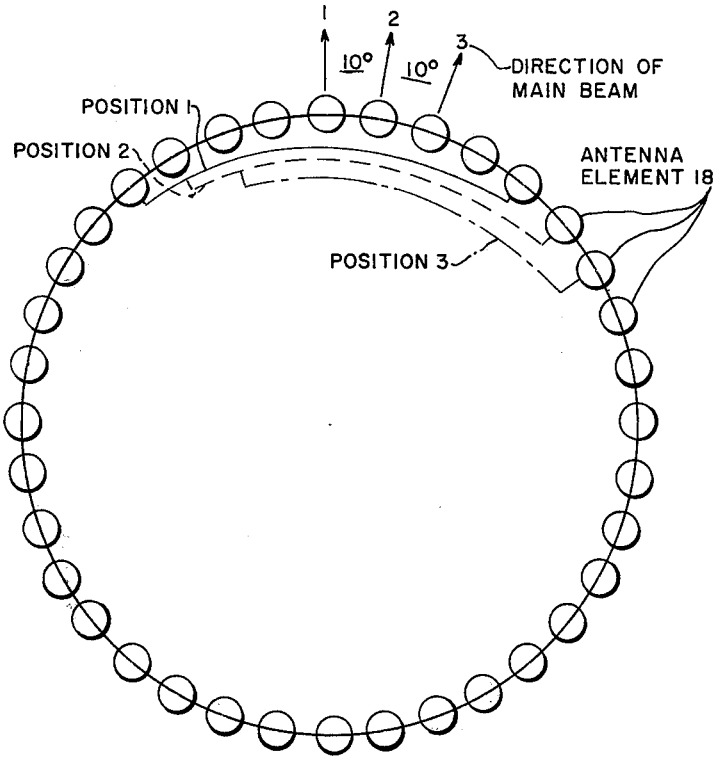
FIG. 4A is a symbolic representation of a 36 element circular array showing the procedure for stepping 2N+1 groups of elements to obtain clockwise scanning.
Figure 4B:
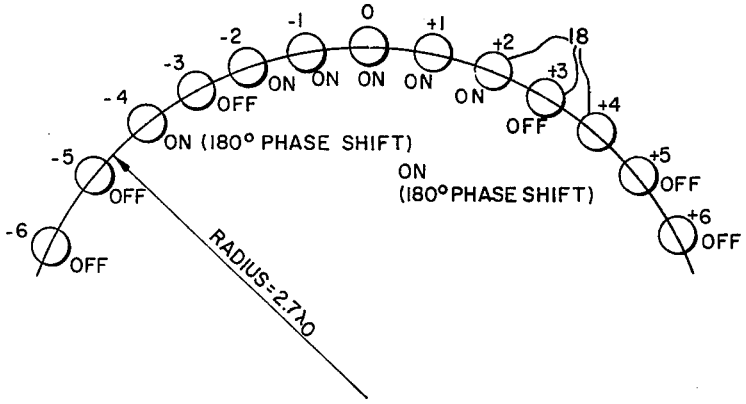
FIG. 4B is a sectional illustration of an array antenna showing the excitation condition of adjoining elements for one scan position.

FIGS. 4A and 4B present a 36 element circular array of radius 2.7 $\lambda_o$ (where $\lambda_o$ equals the free space wavelength of the radio frequency signal). The circular array shown is formed by 36 isotropic antenna elements 18 connected in parallel. Details of the individual elements 18 are shown in FIGS. 5 through 14. A radio frequency signal is electronically scanned in 36 steps around the array. In each of these steps a sector of the array as shown in FIG. 4A has 2N+1 isotropic antenna elements 18 fed at equal amplitude and in phase. The wavefront propagating from the ±1st elements 18 will be out of phase with the "0"th element by an amount $\phi$ at a phase front parallel to the tangent to the "0"th element. The radiation intensity of each isotropic element has a magnitude $|B| \sim$. Since the radiation of the elements are non-cophasal, an array having all 2N+1 antenna elements in a sector fed, and fed in phase, is not the most efficient use of the RF power available. The radiation intensity at a phase front at an angle $\theta$ with broadside is found by summing the individual contributions of the antenna elements 18. As the elements 18 are isotropic, the differences in contributions are due to the differences between the phase of each contribution at the phase front, which, in turn, are dependent upon the curvature of the array and the inter-element spacing. The difference in phase $\phi$ in radians between the contributions of the "0"th and "$n$"th elements 18 is equal to:

$$\phi = 2\pi\eta\psi/\lambda \qquad (1.)$$

where:

$\eta\psi$ is the distance between the "0"th and "$n$"th elements.

The difference in phase in radians between the 0th and the $n$th antenna elements at a phase front at an angle $\{90° - \phi\}$ with the broadside is:

$$\phi\eta = \frac{4\pi R}{\lambda} \cdot \left\{ \mathrm{SIN}\left[\frac{n \cdot A}{2}\right] \mathrm{SIN}\left[\phi - \frac{\eta A}{2}\right]\right\} \qquad (2)$$

where:

$R$= the radius of the sector in wavelengths;

$A$ = the interelement spacing in radians; and

Each of the 2N+1 group of elements forming a scan position requires an equal amount of RF power. In a power limited application, the efficiency of operation may be improved by turning off those antenna elements more distant from the 0th element. For a nine element group (e.g., $N$=4), the two-ninths power normally transmitted through the ±3 elements adds little to the gain of the normal beam pattern. Accordingly, for each group, the ±3 elements are shut off and their two-ninths of the power is redistributed to the remaining seven elements, thereby making a more efficient use of the available power.

Each scan position consists of a 9-element set with the ±3rd element turned off and the ±4th element phase shifted by 180° as shown in FIG. 4 to suppress the sidelobes of the beam to make it more directional. In fact, the theoretical pattern achieved by this arrangement is highly directional. As such the pattern shows at 14° beamwidth in the azimuth plane coupled with the predicted 90° elevation beamwidth of the slot element, resulting in a directivity of 13.25. The sidelobes are 9.7 dB down from the level of the main beam. Taking into account losses in the feedlines, the gain of the system is about 12 dB above isotropic.

As shown in FIG. 4A, seven antenna elements are turned on and 29 are off for any given scan position. To scan the beam, the end element is turned off and the one at the other end is turned on. The main direction of the main beam is shifted 10° each time this is done, and so on and so forth on around the circle.

THE STRIPLINE ELEMENT

Figure 5:
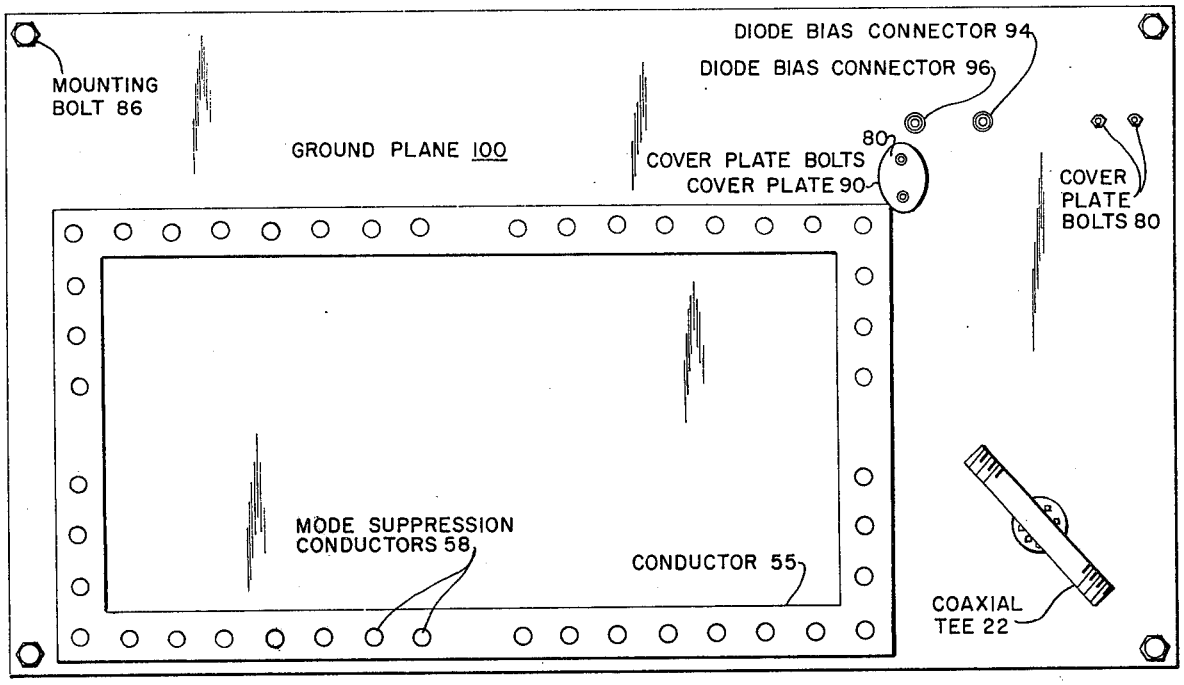
FIG. 5 is a top view of one exposed surface serving as the inner ground plane of a stripline antenna element in an array as shown by FIG. 1.

The antenna elements 18 of array 8, 9 each include, a two-bit switched alternate path coupled by a quarter-wavelength radio requency transformer 56 to a stripline slot antenna element. Referring now to FIG. 5, the surface acting as one ground plane 100 of an element 18 exposed to the inner volume of an array 8, 9 is shown. A radio frequency signal enters the element 18 via coaxial tww 20 through the corresponding connecting cable 16 (not shown). A pair of diode bias parts or connectors 94, 96 permit a source of bias energy (e.g., a battery) to be fed to the alternate path switching circuit via individual bias cables 95 and fee-through capacitors 38, 39 (not shown). Mode suppression eyelettes 58 are electrically conducting devices for coupling the exposed ground planes 100, 106, and for defining the internal resonant cavity. The mode suppression buttons 58 are electrically coupled by a conductor 55, such as metallic paint or tape. Cover plate 90 holds in place an electronic device 36 corresponding to bias feed port 96. Cover plate bolts 80 pass through a similar cover plate 91 on the opposite ground plane 106. Typically, ground planes 100 and 106 are formed by etching away a conductive cladding (e.g., copper) from around ports such as bias connector 94, 96 and coaxial tee 20.

Figure 6:
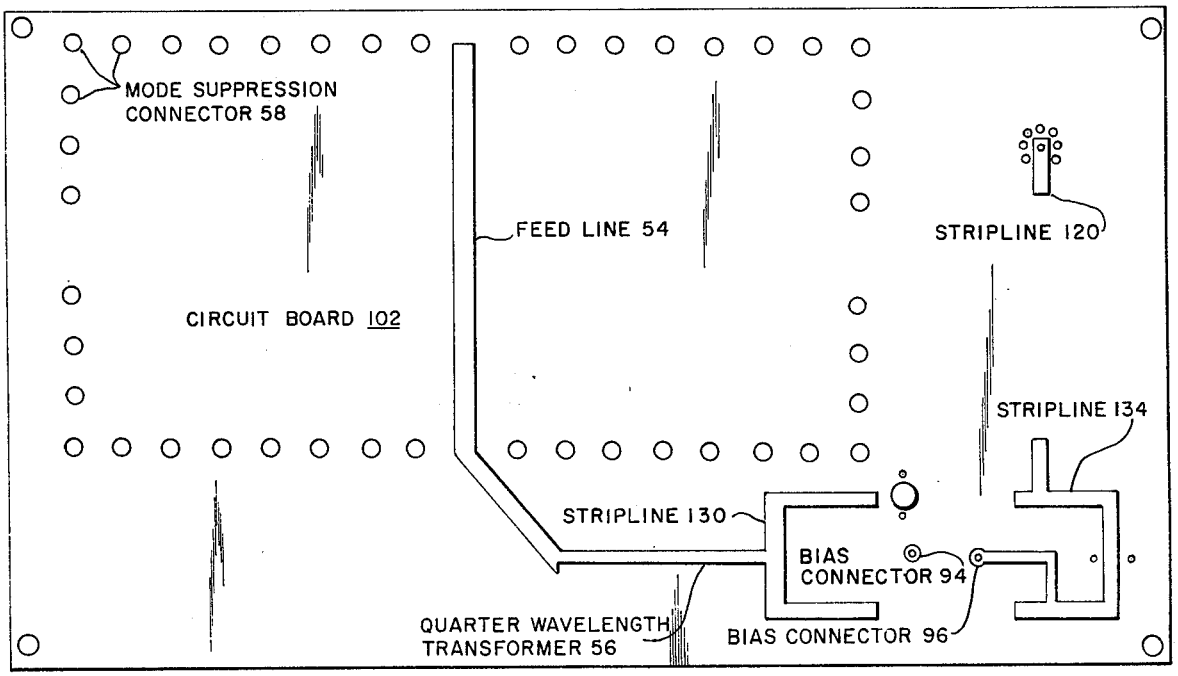
FIG. 6 is a top view of the unexposed reverse surface of the stripline element shown by FIG. 5.
Figure 7:
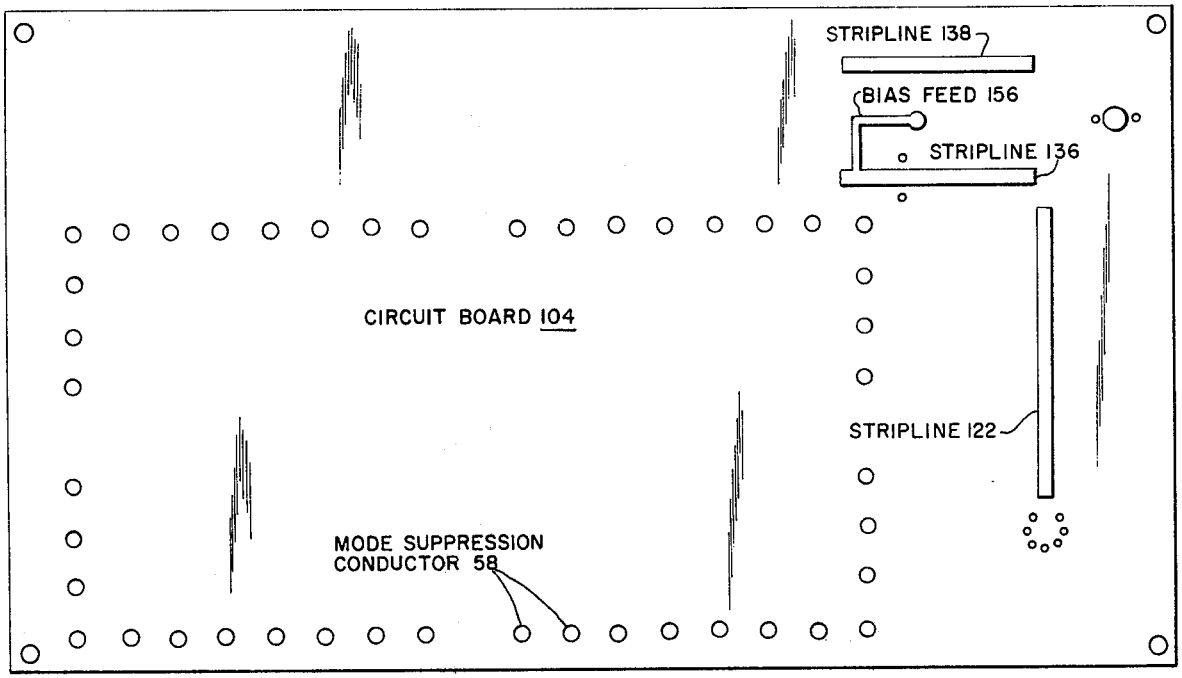
FIG 7. is a top view of the unexposed surface of a stripline element mating with the surface shown by FIG. 6.

FIGS. 6 and 7 set forth the mated stripline circuits of the two bit alternate path and the antenna sections of the circuit board 102, 104, respectively, that are etched into the reverse side of dielectric (e.g., glass filed Telfon R) on which ground planes 100, 106 are mounted Stripline 120 couples to the coaxial conductor of tee 20 and conveys radio frequency signal through a direct current block 32 (e.g., a dielectric film such as Mylar R), to stripline 122, and again through the direct current block to stripline 134. Stripline 134 feeds the radio frequency signal into the two parallel paths, 11, 21, of the two bit switching section. One of the parallel paths 11, 21 must be transversed before the radio frequency signal is able to reach the quarter wavelength transformer 56 and the antenna feed line element 54. Bias feed path 154, separated from coaxial tee 20 by direct current block 32, and from transformer 56 by direct current blocks 40, 44 of paths 11, 21 respectively, couples the bias energy to the diode 34 via stripline 134. Diodes 34 and 36 are placed one quarter of a wavelength from the junction of the corresponding tee 20. Path 21, through diode 34 is one-half of a wavelength longer than path 11 through diode 11, however. Mode suppression eyelettes 58 define the resonant cavity occuring between circuit boards 102, 104.

Figure 8:
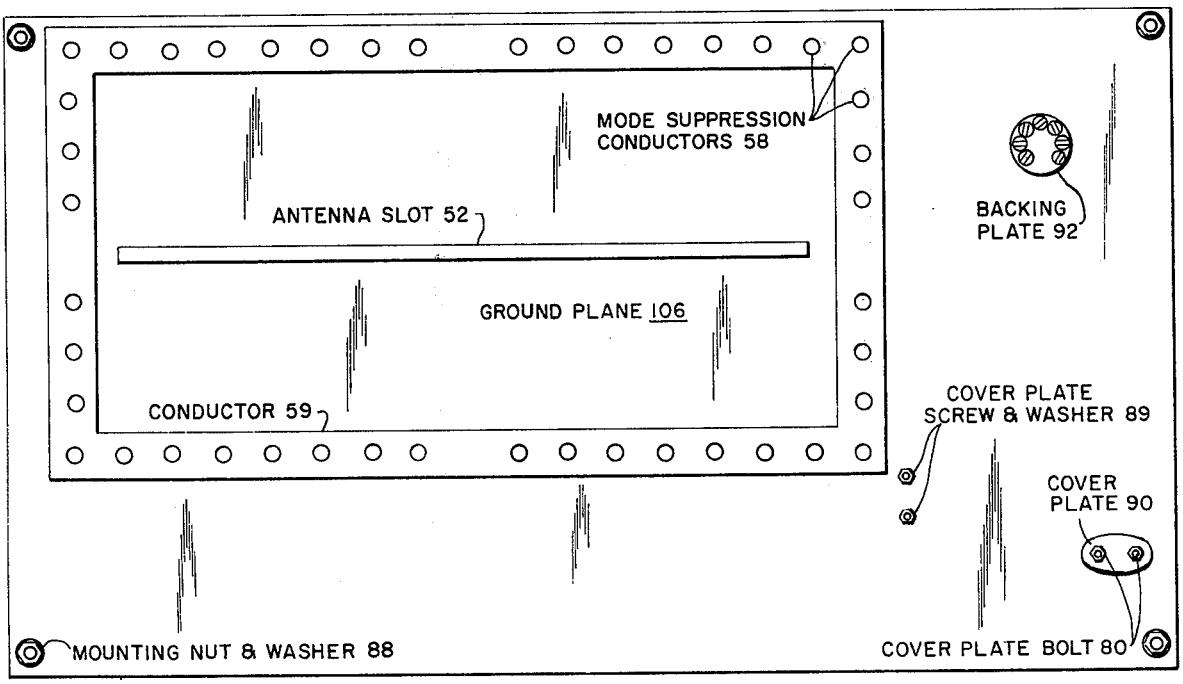
FIG. 8 is a top view of one exposed surface serving as the outer ground plane of a stripline antenna elements in an array as shown by FIG. 1.

FIG. 8 sets forth the exposed outer surface of element 18 of array 8, 9, forming the second ground place 106. Ground planes 100 and 106 are arranged approximately identically and are maintained at equal ground potentials. An antenna slot 52 is formed by etching away the conductive cladding of ground plane 106 one quarter of a wavelength equidistant from the parallel rows of mode suppression buttons 58. The "width" or major dimension of slot 52 is proportional to the resonant frequency of the element 18, and may be varied by placing conductive strips (e.g., silver tape) at various positions near the extremities of the width. The minor dimension or "gap" of the slot 52 is proportional to the impedance of the antenna section. Backing plate 92 is a non-electrical component providing mechanical support for the corresponding coaxial tee 20 and feed cables 16.

Figure 9:
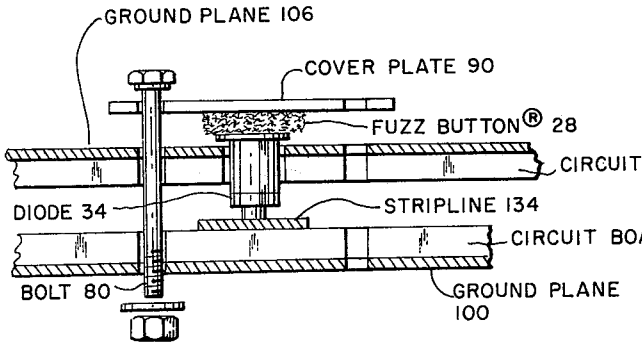
FIG. 9 is an exploded sectional side view showing the position of a typical electronic device between the surfaces of the stripline element shown by FIGS. 5, 6, 7 and 8.

FIG. 9 is an exploded sectional view showing the typical placement of a diode 34 in relation to ground planes 100, 106 and the connecting stripline 134. A Fuzz button 28, a compressible electrical conductor formed with wire mesh, holds diode 34 in place in order to counteract thermal expansion of the surfaces of element 18 caused by a change in ambient temperatures such as that occuring between noon and midnight. The junction of the corresponding bias feed 154 and stripline 134 is not shown.

Figure 10:
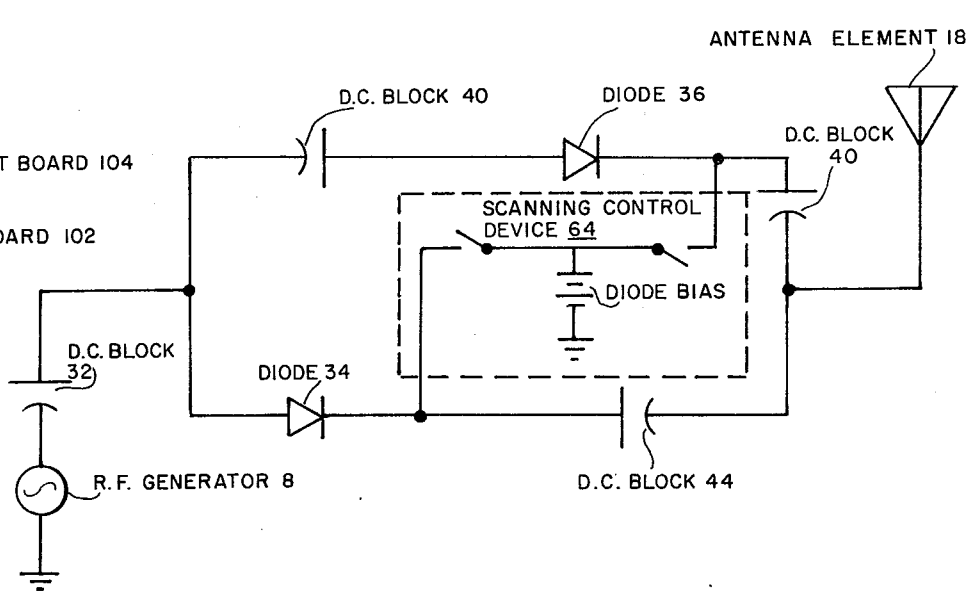
FIG. 10 is a schematic drawing showing an equivalent direct current presented by a switching and antenna element sections of a typical stripline antenna element.

FIG. 10 set forth an equivalent direct current circuit presented by the switching and antenna sections of one element 18. Scanning control 64 keeps the source of bias energy 66 normally applied through the corresponding logic switches, bias cables 96 and feed through capacitors 38, 39 (not shown), to foreward bias diodes 34, 36, respectively. Direct current blocks 32, 40 and 44 prevent the bias current from interfering with the operation of the radio frequency circuitry. Typically, diodes 34, 36 are PIN diodes requiring no negative ten volts back bias to be turned off and one hundred milliamperes foreward bias (a positive ten volts applied across a current limiting resistor) to be turned OFF.

Figure 11:
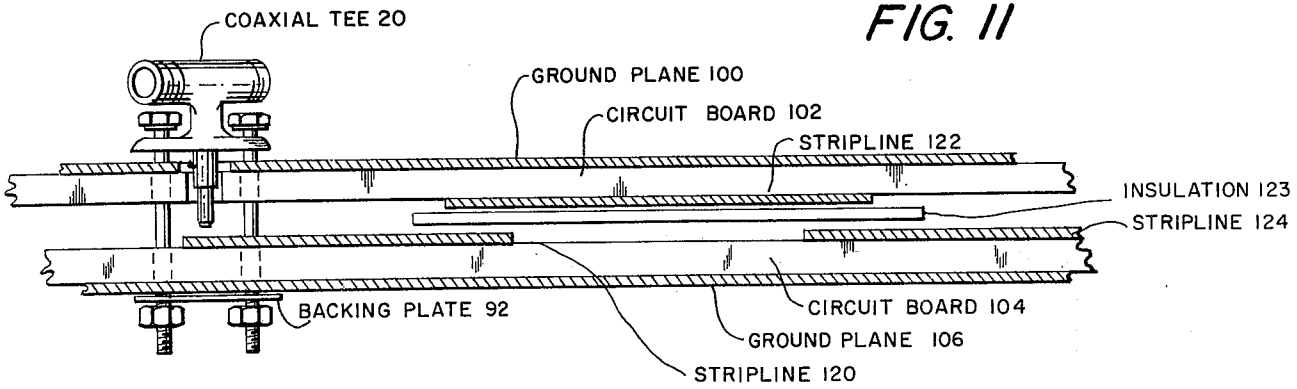
FIG. 11 is an exploded sectional side view showing the position of a coaxial tee and a direct current blocking dielectric between the surfaces of the stripline element shown by FIGS. 5, 6, 7 and 8.

FIG. 11 is an exploded sectional view illustrating the placement of an insulating film 123 to provide a typical direct current block 32. Coaxial tee 20 mates against stripline 120 of circuit board 104. Stripline 122 mates with stripline 120 and 124 to provide a radio frequency path through the insulating dielectric 123.

Figure 12:
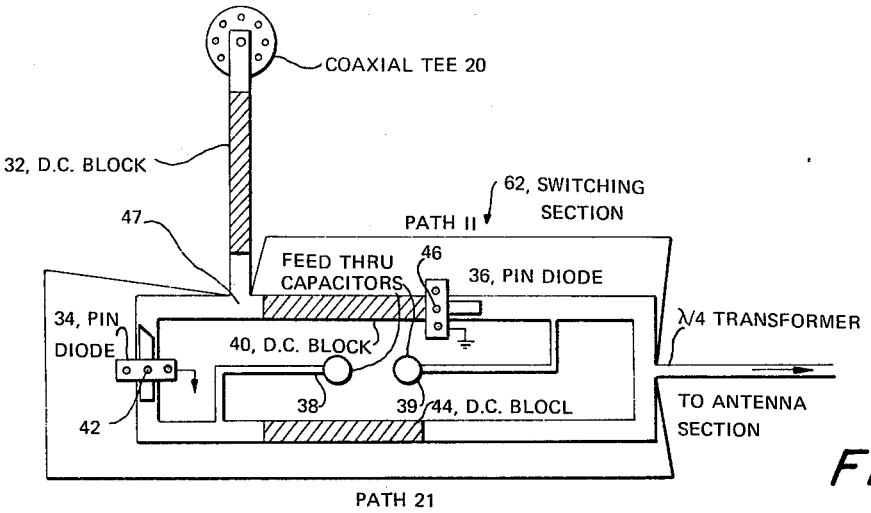
FIG. 12 is a schematic representation of the switching section of a typical stripline element.

FIG. 12 shows the details of the composite switched line section of the antenna element which determines whether the respective antenna is off, on with no phase shift, or on with 180° phase shift. The PIN diodes 34, 36 are biased ON and OFF through the diode switch connectors (not shown). Since the diodes 34, 36 are in parallel with the RF feed line paths 21, 11, respectively, forward bias causes a shorted circuit across the line. The shorted circuit appears as an open circuit impedance at the input tee-junction 22. Reverse bias to a PIN diode places a high impedance in parallel with the much lower antenna impedance so only the parallel impedance appears at tee-junction 20. Both PIN diodes 34, 36 are forward biased to turn an element OFF. The diode 36 in the shorter wavelength path 11 is reversed biased to turn the antenna ON with a zero-degree reference phase. To obtain a 180° phase shift, the diode 34 in the three-quarter-wavelength path 21 is reversed biased, thereby presenting a path exactly one-half-wavelength longer to the RF power. 30 travels through the Fuss botton 28, through the D.C. block 32 and down path 11, through the $\lambda/4$ transformer 48 to the antenna section of the element. Note that path 11 is considered the path of zero phase shift.

Condition 3, Antenna is on with 180° of phase shift: A D.C. control signal is sent through feed through capacitor 39 to PIN diode 36 creating RF short at point 46. Thus in this case path 21 is "on", and RF power entering the stripline right angle connector 30 at tee junction 26 travels through Path 21 on its way to the antenna section. Since Path 21 is one-half wavelength longer than Path 11, the RF energy entering the antenna section is phase shifted by 180° relative to that of the elements on which condition 2 is operating.

In all three conditions, the D.C. block 32 prevents any of the D.C. signals from traveling through the corporate feed network to other antenna elements.

Figure 13:
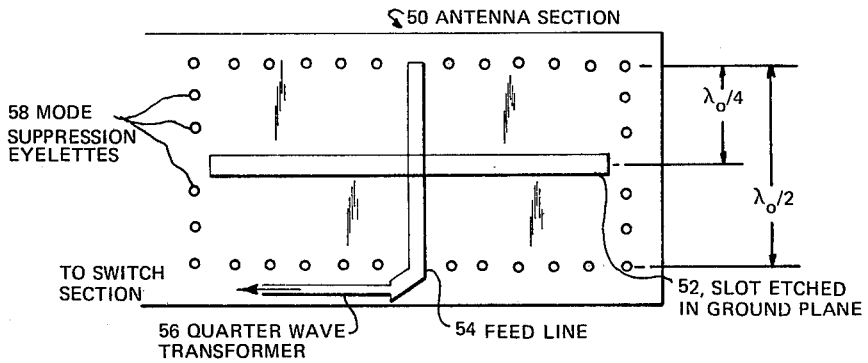
FIG. 13 is a schematic representation of the antenna element section following the switching section shown by FIG. 12.

FIG. 13 shows the composite antenna section 50 of stripline element which radiate RF energy coming from the switching section 62. RF comes through quarter wave transformers 56 travels up feedline 54 and radiates out of a slot etched in the ground plane 52. The gain of the antenna is a function of the aperture of slot 52. Mode suppression eyelettes 58 help to maintain proper RF filed with radiating section. Seven antenna elements over a span of the nine elements in a sector are turned ON to form the array pattern. To radiate a beam in a particular direction, the element looking in that direction, and the nearest two elements on both sides, are turned ON with a zero degree phase shift. The third elements on both sides will contribute little to the radiated pattern, are turned OFF thereby increasing the power available to the remaining seven elements by two ninths. The fourth elements on both sideas are turned ON with a 180° phase shift. To scan, this same pattern of ON elements is moved around the array in 10° increments by essentially dropping an element 18 at one end and picking up one element 18 at the other end.

Condition 1, Antenna is off:

A D.C. bias signal from scanning control device 64 is sent through feed through capacitors 38 and 39 to both PIN diodes 34 and 36. The diodes are thus shorted to the ground planes thereby creating RF shorts at points 42 and 46. At the tee junction 22 which is three quarters of wavelengths away, these RF shorts appear as RF open circuits and all of the RF power goes straight through the coaxial tee 20.

Condition 2, Antenna is on with no phase shift:

A D.C. bias signal is sent through feed through capacitor 38 to PIN diode 34 causing RF short at point 42. Thus path 21 looks like a RF open circuit at the tee junction 22 as in condition 1. However, due to D.C. blocks 40 and 44 no D.C. signal goes to PIN diode 36 so path 11 is "on". Thus, part of the RF power traveling through coaxial tee 24 enters the stripline right angle connector.

Figure 14:
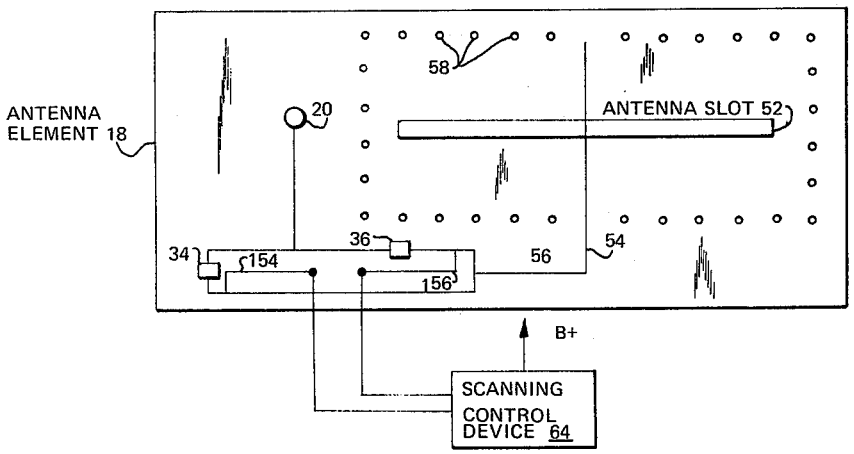
FIG. 14 is a schematic representation of a complete stripline having a single switching and antenna element section.

FIG. 14 is a general composite view of the switching section 62, slot antenna section 50, and the scanning control device 64 comprising a complete stripline antenna element and control. The control device 64 applies D.C. signals to feed through capacitors 38 and 39 to control the states of the pin diodes 34 and 36. Similar control bias signals are applied to the other switching sections to control the operating mode of each antenna element. The scanning control device can comprise any well known switching mechanism such as a commutator for successively applying D.C. signals to a number of devices. For varying the switching pattern, any well known digitally controlled switching device can be used. The configuration of the stripline antenna element of FIG. 8 is compact and inexpensive to construct. Its size allows adaptation to a broad range of frequencies for radar or communication purposes.

In view of the above teachings it is apparent that the embodiments of this invention overcomes the disadvantages and limitations of the prior art by providing an isotropic, stepped scanning array antenna having a conformal beam radiated by a plurality of stripline elements switched by a simple switching circuit.

Obviously many modifications and variations of the present invention are possible in light of the above teachings. For example, it is well known in the art to use antenna scanning systems for either transmitting or receiving signals. The present system could, of course, be used to either transmit or receive various electromagnetic readiation for various purpose including radar scanning and communications. Also, the antenna elements could be placed at even multiples of the wavelength of the RF input signal. In addition, the array could be arranged in any geometrical configuration to scan in different geometrical arrangements. By using two or more slots 52 per element 18, an array would have an increase in gain with a decrease in vertical beamwidth. In such an arrangement if one element 18 circuit failed, the entire array 8, 9 would undergo a gradually diminished performance rather than a catastropic failure accompanying the failure of a single slot element 18.

If one array is devoted solely to transmission or reception of a radio frequency signal, then the switching section circuitry 62 may be immediately preceeded by either a final RF amplifier or a receiver RF preamplifier, respectively, thereby permitting a more compact signal processing device. Each element 18 would act as a heat sink for the electronic components of the amplifier while the components will simultaneously act as a heater (e.g., defroster) for the element 18.

What is claimed as new and desired to be secured by Letters Patent of the United States is:

1. An antenna for scanning a spherical sector comprising:

a plurality in excess of $2N + 1$ where N is an integer valve, of antenna elements oriented normal to said spherical sector and spaced tangentially along an arc within said spherical sector;

a radio frequency device for processing a signal having a characteristic wavelength;

conductive means electrically coupled to said signal processing means for providing a plurality equal to the number of said antenna elements, of non-cophasal radio frequency paths differing in length by multiples of one said wavelength;

a plurality of networks equal in number to said antenna elements, each network providing a minor path and a major path one-half of a wavelength longer than the minor path, for radio frequency energy passing between one of said non-cophasal paths and a corresponding one of said antenna elements;

a source of bias energy;

a plurality equal to the sum of the number of said major and minor paths, of electronic devices, each device providing a shorted circuit between a ground potential and a point on a corresponding said network path one quarter of said wavelength from the junction of that network and the corresponding said non-cophasal path in response to reception of said bias energy; and switching means for electrically coupling each of said electronic devices to said source of bias energy according to a selected sequence;

whereby said antenna scans said spherical sector in successive overlapping sectorates of that part of said sector having an arcuate width in conformance with said arc by sequentially exciting each stepped groups of $2N + 1$ said elements symmetrical about a normal bisecting the successive corresponding sectorates wherein for each sectorate all of said plurality of electronic devices except those electronic devices providing shorted circuits to the minor paths of those networks corresponding to the N adjoining said elements symmetric about said normal and those networks corresponding to those elements next adjoining but one from said N adjoining elements are coupled via said switching means to said source of bias energy.

2. The antenna as set forth in claim 1 wherein N equals 3.

3. The antenna as set forth in claim 1 wherein N equals 4.

4. The antenna as set forth in claim 1 wherein said radio frequency signal processing device comprises a receiver.

5. The antenna as set forth in claim 1 wherein said radio frequency signal processing device comprises a transmitter.

6. The antenna as set forth in claim 1 wherein said radio frequency signal processing device comprises a transmitter generating a continuous wave signal.

* * * * *

UNITED STATES PATENT OFFICE

CERTIFICATE OF CORRECTION

Patent No. 4,021,813 Dated May 3, 1977

Inventor(s) Lawrence M. Black et al.

It is certified that error appears in the above-identified patent and that said Letters Patent are hereby corrected as shown below:

Column 1, line 6, cancel "C-1-P".

Signed and Sealed this sixteenth Day of August 1977

[SEAL]

Attest:

RUTH C. MASON
*Attesting Officer*

C. MARSHALL DANN
*Commissioner of Patents and Trademarks*